US011555252B2

(12) United States Patent
Bokisa et al.

(10) Patent No.: US 11,555,252 B2
(45) Date of Patent: Jan. 17, 2023

(54) SATIN COPPER BATH AND METHOD OF DEPOSITING A SATIN COPPER LAYER

(71) Applicant: COVENTYA, INC, Brooklyn Heights, OH (US)

(72) Inventors: George Bokisa, North Olmsted, OH (US); Claire Theuret, Brooklyn Heights, OH (US)

(73) Assignee: Coventya, Inc., Brooklyn Heights, OH (US)

( * ) Notice: Subject to any disclaimer, the term of this patent is extended or adjusted under 35 U.S.C. 154(b) by 0 days.

(21) Appl. No.: 17/292,211

(22) PCT Filed: Nov. 1, 2019

(86) PCT No.: PCT/US2019/059496

§ 371 (c)(1),
(2) Date: May 7, 2021

(87) PCT Pub. No.: WO2020/096906

PCT Pub. Date: May 14, 2020

(65) Prior Publication Data

US 2021/0404083 A1 Dec. 30, 2021

Related U.S. Application Data

(60) Provisional application No. 62/756,787, filed on Nov. 7, 2018.

(51) Int. Cl.

| | |
|---|---|
| ***C25D 3/38*** | (2006.01) |
| ***C25D 5/00*** | (2006.01) |
| ***C25D 5/10*** | (2006.01) |

(52) U.S. Cl.
CPC ..... *C25D 5/611* (2020.08); *C25D 3/38* (2013.01); *C25D 5/10* (2013.01); *C25D 5/627* (2020.08)

(58) Field of Classification Search
CPC ..... C25D 3/38; C25D 5/627
USPC ..... 205/296
See application file for complete search history.

(56) References Cited

U.S. PATENT DOCUMENTS

| | | | |
|---|---|---|---|
| 2,424,887 A | 7/1947 | Henricks | |
| 4,242,181 A | 12/1980 | Malak | |
| 4,334,966 A | 6/1982 | Beach et al. | |
| 4,430,173 A | 2/1984 | Boudot et al. | |

(Continued)

FOREIGN PATENT DOCUMENTS

| | | | | |
|---|---|---|---|---|
| CN | 105441994 B | | 9/2017 | |
| JP | 2002053994 A | * | 2/2002 | ..... C25D 3/38 |
| WO | 2006132978 A1 | | 12/2006 | |

OTHER PUBLICATIONS

Chai et al., "Effects of Various Additives on the Cloud Point of Dodecyl Polyoxyethylene Polyoxypropylene Ether," Colloid Journal (Sep. 2002), vol. 64, No. 5, pp. 550-555. (Year: 2002).*

(Continued)

*Primary Examiner* — Edna Wong
(74) *Attorney, Agent, or Firm* — Carmody Torrance Sandak & Hennessey LLP

(57) ABSTRACT

An aqueous acidic copper electroplating bath that produces a satin deposit includes a source of copper ions, an acid, a satin additive, and optionally one or more acidic copper electroplating bath additive(s), wherein the satin additive includes a block copolymer with the structure of RO(EO)m(PO)nH.

16 Claims, 13 Drawing Sheets

(56) References Cited

U.S. PATENT DOCUMENTS

| | | | | |
|---|---|---|---|---|
| 4,490,220 | A | 12/1984 | Houman | |
| 4,540,473 | A | 9/1985 | Bindra et al. | |
| 4,551,212 | A | 11/1985 | Rao et al. | |
| 4,673,467 | A | 6/1987 | Nee | |
| 4,781,801 | A | 11/1988 | Frisby | |
| 4,897,165 | A | 1/1990 | Bernards et al. | |
| 4,948,474 | A | 8/1990 | Miljkovic | |
| 4,954,226 | A | 9/1990 | Mahmoud | |
| 4,975,159 | A | 12/1990 | Dahms | |
| 4,990,224 | A | 2/1991 | Mahmoud | |
| 5,024,736 | A | 6/1991 | Clauss et al. | |
| 5,068,013 | A | 11/1991 | Bernards et al. | |
| 5,145,572 | A | 9/1992 | Hupe et al. | |
| 5,151,170 | A | 9/1992 | Montgomery et al. | |
| 5,174,886 | A | 12/1992 | King et al. | |
| 5,403,465 | A | 4/1995 | Apperson et al. | |
| 5,417,841 | A | 5/1995 | Frisby | |
| 5,431,803 | A | 7/1995 | DiFranco et al. | |
| 5,433,840 | A * | 7/1995 | Dahms | C25D 3/38 106/1.26 |
| 6,458,264 | B1 | 10/2002 | Muramatsu et al. | |
| 6,479,449 | B1 | 11/2002 | Mondin | |
| 2003/0155247 | A1 * | 8/2003 | Miura | C25D 3/38 205/291 |
| 2005/0178668 | A1 | 8/2005 | Mobius et al. | |
| 2006/0012044 | A1 * | 1/2006 | Knop | C25D 5/18 257/750 |
| 2010/0276292 | A1 * | 11/2010 | Webb | H01L 21/2885 205/230 |
| 2013/0098770 | A1 * | 4/2013 | Niazimbetova | C25D 3/38 546/159 |
| 2013/0150276 | A1 | 6/2013 | Dicapua et al. | |
| 2013/0341199 | A1 | 12/2013 | Uchida et al. | |
| 2015/0014177 | A1 | 1/2015 | Kretschmer et al. | |

OTHER PUBLICATIONS

Applicant: Coventya, Inc.; Bath and Method of Depositing a Sating Copper Layer; PCT International Application No. PCT/US2019/0594996; PCT International Search Report; Authorized Officer: Blaine R. Copenheaver; dated Jan. 13, 2020; 3 pgs.

* cited by examiner

A

B

A

B

A

B

A

B

A

B

A

B

A

B

A

B

A

B

A

B

A

B

SATIN COPPER BATH AND METHOD OF DEPOSITING A SATIN COPPER LAYER

RELATED APPLICATION

This application claims benefit from U.S. Provisional Application No. 62/56,787, filed Nov. 7, 2018, the subject matter of which is incorporated herein by reference in its entirety.

BACKGROUND

Satin nickel coatings can be used as an intermediate layer or underlayer in decorative multilayer coating systems. Nickel, however, is an allergen, and nickel salts can be carcinogenic, mutagenic and reprotoxic. This makes the use of nickel more restricted, especially for fashion and jewellery applications. Several attempts have been made to develop a nickel-free electrolytic deposit for obtaining a satin layer.

U.S. Patent Application Publication No. 2005/0178668 A1 discloses a method for depositing nickel and chromium (VI)-free metal matte layers. The first matte layer is free of nickel and comprises at least one metal selected from the group consisting of copper, silver, tin, zinc or an alloy, which does not contain nickel. This method allows one to obtain a "matte" layer defined as a dull, non-glare or pearl surface finish. However, the matte layer obtained is not characterized and the additive used is a commercial additive without any indication about the chemistry of the molecule used. Additionally, there is no indication about the stability of the satin emulsion, which should be maintained to obtain a constant and uniform satin finish.

U.S. Patent Application Publication No. 2013/0341199 A1 discloses a copper electroplating additive and copper electroplating bath to provide a glossy copper plating film. To obtain a uniform plating film in a range from a low current density to high current density and provide a good glossiness, a block copolymer compound R—O—(PO)m—(EO)n—H is used in an acidic copper electroplating bath. The additive has a structure in which one end includes an oxypropylene group capped with an alkyl group or an alkenyl group. This allows one to obtain a portion of R—O—(PO)m, which act together as a hydrophobic group, whereby high hydrophobicity is provided.

U.S. Patent Application Publication No. 2015/0014177A1 discloses a method for deposition of a matte copper coating comprising two layers to obtain a homogeneous matte appearance for decorative applications. However, the matte layers obtained are not characterized and the copper electroplating bath used to form the copper coating only includes additives, such as polyethylene glycol and a sulfur-containing additive.

SUMMARY

Embodiments described herein relate to an aqueous acidic copper electroplating bath that can be used to provide a satin layer of copper, i.e., a copper coating with a satin appearance, on a surface of a substrate or work piece including a work piece with a complex shape. Advantageously, the copper electroplating bath can be use for decorative applications to replace satin nickel. The copper electroplating bath is substantially non-allergenic and eco-friendly as result of being nickel-free and includes a source of copper ions, an acid, a satin additive, and optionally one or more acidic copper electroplating bath additive(s). The satin additive includes a block copolymer, which has a fixed sequence of an oxyethylene group (EO) and an oxypropylene group (PO), with the structure of $RO(EO)_m(PO)_nH$, wherein R represents an alkyl group or alkenyl group having a linear or branched chain structure and having a carbon number of 5 to 20, m is an integer of 3 to 7, and n is an integer of 3 to 6.

In some embodiments, the acidic copper electroplating bath additive(s) can include at least one additive selected from the group consisting of reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyalkylene glycols; block copolymers with the structure of OH(EO)x(PO)y(EO)zH where x, y, and z are integers between 1 and 10; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; arylamines, substituted phenylphenazinium compounds and substituted benzothiazole compounds.

In some embodiments, the satin additive can be provided in the acidic copper electroplating bath at a concentration of about 1 mg/L to about 1 g/L, for example, about 50 mg/L to about 500 mg/L or about 100 mg/L to about 300 mg/L.

In other embodiments, the source of copper ions can be a copper salt, such as copper sulfate pentahydrate. The copper salt can be provided in the acidic copper electroplating bath at a concentration of about 50 g/L to about 260 g/L, for example, about 100 g/L to about 200 g/L or about 130 g/L to about 180 g/L.

In some embodiments, the acid can be selected from sulfuric acid, fluoboric acid, phosphoric acid, an alkane sulfonic acid, an alkanol sulfonic acid or combinations thereof. For example, the acid can include sulfuric acid at a concentration of about 50 g/L to about 260 g/L, about 80 g/L to about 170 g/L, or about 110 g/L to about 150 g/L.

In still other embodiments, the aqueous acidic copper electroplating bath can further include halide ions. The halide ions can be provided in the acidic copper electroplating bath at a concentration of about 20 mg/l to about 200 mg/l.

Other embodiments described herein relate to a method for deposition of copper onto a substrate. The method can include providing a substrate and contacting the substrate with an aqueous acidic copper electroplating bath as described herein. An electrical current can be applied between the substrate and at least one anode to deposit copper onto the substrate.

BRIEF DESCRIPTION OF THE DRAWINGS

The present invention and advantages thereof will become more apparent upon consideration of the following specification with reference to the accompanying drawings in which.

DETAILED DESCRIPTION

Figure 1:
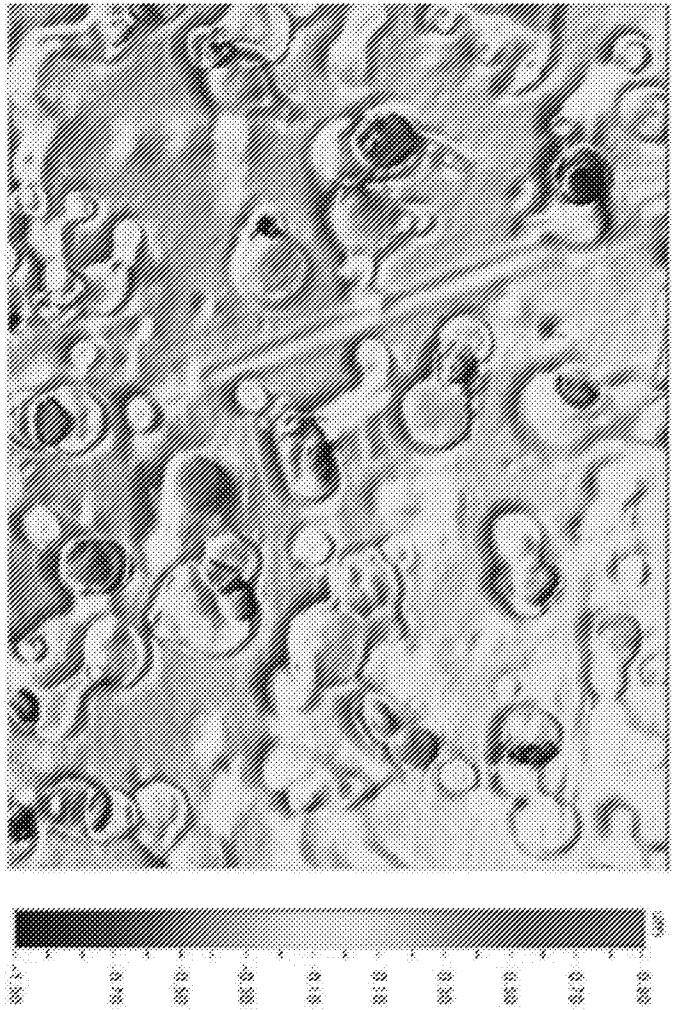
FIG. 1 illustrates an image showing a profile of a satin nickel deposit (Ra=164 nm).

Embodiments described herein relate to an aqueous acidic copper electroplating bath that can be used to provide a satin layer of copper, i.e., a copper coating with a satin appearance, on a surface of a substrate or work piece including a work piece with a complex shape. Advantageously, the copper electroplating bath can be used for decorative applications to replace satin nickel. The copper electroplating bath is substantially non-allergenic and eco-friendly as result of being nickel-free.

The copper electroplating bath includes a satin additive that allows a conventional copper electroplating bath to form a substantially uniform and homogenous satin copper plating layer on the substrate or work piece at a low current density (e.g., about 0.1 A/dm$^2$) to high current density (e.g., about 8 A/dm$^2$ or more). The copper electroplating bath including the satin additive can produce a scratch resistant copper layer having a homogenous satin aspect at a high total yield.

The satin additive is a non-ionic surfactant that includes a block copolymer or fatty alcohol oxyethylene (EO)/oxypropylene (PO) derivative that has a fixed sequence of an EO group and a PO group. In some embodiments, the satin additive has a structure of R—O—$(EO)_m$—$(PO)_n$—H, wherein R represents an alkyl group or alkenyl group having a linear or branched chain structure and having a carbon number of 5 to 20 (e.g., $C_8$-$C_{16}$ alkyl or $C_{12}$-$C_{14}$ alkyl), m is an integer of about 3 to about 7 (e.g., 4 to 6), and n is an integer of about 3 to about 6 (e.g., 4 to 5). In some embodiments, m is greater than n. In other embodiments, m is less than n. In still other embodiments, m is equal to n.

In one example, the satin additive can comprise a block copolymer having the general formula (I):

$$RO-(CH_2-CH_2-O)_m-(CH(CH_3)-CH_2-O)_n-H \quad (I)$$

wherein R represents an alkyl group or alkenyl group having a linear or branched chain structure and having a carbon number of 5 to 20 (e.g., $C_{12}$-$C_{14}$ alkyl), m is an integer of about 3 to about 7 (e.g., 4 to 6), and n is an integer of about 3 to about 6 (e.g., 4 to 5). In some embodiments, R is a linear or branched $C_{12}$-$C_{14}$ alkyl. In other embodiments, m is greater than n. or m is less than n. In still other embodiments, m is equal to n.

The satin additive having the formula $R—O—(EO)_m—(PO)_n—H$ can be provided in the copper electroplating bath at a concentration of about 1 mg/L to about 1 g/L, for example, about 50 mg/L to about 500 mg/L or about 100 mg/L to about 300 mg/L. By adding the satin additive to an acidic copper electroplating bath, a uniform satin copper layer can be obtained in a wide range of current density (e.g., about 0.1 $A/dm^2$ to about 8 $A/dm^2$ or more). The concentration of the satin additive in the copper electroplating bath can be readily managed by removing the additive by active carbon filtration. Moreover, the satin additive is not consumed when the copper electroplating bath is not in use.

The acidic copper electroplating bath comprises an aqueous solution. However, the copper plating bath may optionally contain one or more co-solvents. Such co-solvents include water-miscible solvents, such as alcohols, glycols, alkoxy alkanols, ketones, and various other aprotic solvents. Specific examples of co-solvents include methanol, ethanol, propanol, ethylene glycol, 2-ethoxy ethanol, acetone, dimethyl formamide, dimethyl sulfoxide, acetonitrile, and the like.

Copper is generally present in the copper electroplating bath in an ionic state ($Cu^{2+}$). The copper can be provided in the bath by adding a copper source, such as one or more copper salts, to the electroplating bath. For example, copper may be obtained from a copper salt such as copper sulfate, copper polyphosphate, copper sulfamate, copper chloride, copper formate, copper fluoride, copper nitrate, copper oxide, copper tetrafluoroborate, copper trifluoromethanesulfonate, copper trifluoroacetate, or hydrates thereof, such as copper sulfate pentahydrate.

In some embodiments, the copper electroplating bath can include a copper salt, such as copper sulphate pentahydrate ($CuSO_4.5H_2O$), at a concentration of about 70 g/l to about 250 g/L, for example, about 100 to about 200 g/L or about 130 g/L to about 180 g/L.

The copper electroplating bath can also include at least one acid. In some embodiments, the acid can be sulfuric acid, fluoboric acid, phosphoric acid, alkane sulfonic acid, an alkanol sulfonic acid or combinations thereof. In one example, the copper electroplating bath includes sulfuric acid and an optional supplemental acid. The optional supplemental acid can include, for example, fluoboric acid, alkane sulfonic acids, and alkanol sulfonic acids.

In some embodiments, the copper electroplating bath can include about 50 g/L to about 180 g/L of concentrated sulfuric acid, for example, about 80 g/L to about 170 g/L or about 110 g/L to about 150 g/L sulfuric acid. When the copper electroplating bath contains sulfuric acid and one or more supplemental acids, the ratio of sulfuric acid to supplemental acid (total amount of sulfuric acid to the total amount of supplemental acids) is maintained to promote the efficient plating of copper on a substrate. Typically, in most embodiments, more sulfuric acid is employed compared to supplemental acid.

The copper electroplating bath can also include chloride ions. In many instances, the presence of a small amount of chloride ions in the copper electroplating bath can facilitate the plating process and improves the characteristics of the resultant layer of copper. Chloride ions can be introduced into the copper electroplating bath by the addition of hydrochloric acid or a chloride salt, such as sodium chloride.

In one embodiment, the copper electroplating bath can include about 20 to about 120 mg/L of NaCl, for example, about 50 mg/L to about 70 mg/L NaCl or about 30 to about 60 mg/L chloride ions.

In some embodiments, the acidic copper electroplating bath has a composition comprising, consisting essentially, or consisting of about 70 g/L to about 250 g/L of copper sulphate pentahydrate ($CuSO_4.5H_2O$) (e.g., about 100 g/L to about 200 g/L or about 130 g/L to about 180 g/L), about 50 g/L to about 180 g/L of concentrated sulfuric acid (e.g., about 80 g/L to about 170 g/L or about 110 g/L to about 150 g/L), about 20 mg/L to about 120 mg/L of NaCl, (e.g., about 40 mg/L to about 80 mg/L or about 50 mg/L to about 70 mg/L), and about 1 mg/L to about 1 g/L of the satin additive (e.g., about 50 mg/L to about 500 mg/L or about 100 mg/L to about 300 mg/L).

The copper electroplating bath can optionally include one or more conventional acidic copper electroplating bath additives to facilitate the plating process (e.g., to provide good throwing power) and/or improve the characteristics of the resultant layer of copper (e.g., to enhance uniformity of the deposit). Conventional acidic copper electroplating bath additives include, for example, brighteners, carriers, leveling agents, surfactants, wetting agents, complexing agents, chelating agents, reducing agents, and promoters.

In some embodiments, the copper electroplating bath can include 10 ppb or more and about 5 g/l or less of one or more additives/brighteners. In another embodiment, the copper plating bath contains about 100 ppb or more and about 2 g/l or less of one or more additives/brighteners. In yet another embodiment, the copper plating bath contains about 300 ppb or more and about 1 g/l or less of one or more additives/brighteners.

Brighteners contribute to the ability of the copper plating bath to provide copper deposits on substrates. Examples of brighteners that can be used in the copper electroplating bath are sulfate bath brighteners, fluoborate, cyanide, and pyrophosphate plating bath brighteners. Sulfate plating bath brighteners are described in U.S. Pat. Nos. 5,433,840; 5,431,803; 5,417,841; 5,403,465; 5,215,645; 5,174,886; 5,151,170; 5,145,572; 5,068,013; 5,024,736; 4,990,224; 4,954,226; 4,948,474; 4,897,165; 4,781,801; 4,673,467; 4,551,212; 4,540,473; 4,490,220; 4,430,173; 4,334,966; 4,242,181; and 2,424,887, which are herein incorporated by reference in their entirety.

Examples of sulfate bath brighteners that can used in the acid copper electroplating baths include one or more of the reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; gelatine or animal glue; alkoxythio compounds; organic carboxylates; dithiocarbamic acids; disulfides; reaction products of a disulfide, a halohydroxy sulfonic acid, and an aliphatic aldehyde; polyalkylene glycols, such as polypropylene glycols, and especially those having a molecular weight from about 1,000 to about 90,000; urea; thiourea; organic thiourea compounds; acetamides; sulfurized, sulfonated organic compounds, such as sulfurized, sulfonated benzenes; reaction products of dialkylaminothioxomethyl thioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons, such as sulfurized benzenes; alkylated polyalkyleneimines; phenolphthalein; epihalohydrins; sulfoalkylsulfide compounds; arylamines; polysulfides; polymeric phenazonium compounds; and sulfonium compounds Fluoborate, cyanide, and pyrophosphate brighteners generally include mercaptothiadiazoles, iminodiacetic acid, acetylenic alcohols, sulfamic acids, glucoheptonic acid, and phosphonates. In one embodiment, the plating baths of the present invention do not contain fluoborate, cyanide, and pyrophosphate brighteners.

Leveling agents promote the formation of a flat, planar surface of the plated copper layer, even if the surface on which the copper layer is formed is not smooth. Examples of leveling agents include the condensation products of thiourea and aliphatic aldehydes; thiazolidinethiones; imidazolidinethiones; and quaternized polyamines; and the like.

Wetting agents promote leveling and brightening, as well as promoting bath stability. Examples of wetting agent include polyoxyalkylated naphthols; ethylene oxide/polyglycol compounds; sulfonated wetting agents; carbowax type wetting agents; and the like.

Surfactants contribute to the overall stability of the bath and improve various properties in the resultant copper layer. General examples of surfactants include one or more of a nonionic surfactant, cationic surfactant, anionic surfactant, and amphoteric surfactant. Specific examples of surfactants include nonionic polyoxyethylene surfactants; alkoxylated amine surfactants; ethylene oxide-fatty acid condensation products; polyalkoxylated glycols and phenols; betaines and sulfobetaines; amine ethoxylate surfactants; quatemary ammonium salts; pyridinium salts; imidazolinium salts; sulfated alkyl alcohols; and sulfated lower ethoxylated alkyl alcohols; and the like.

Chelating agents facilitate the displacement of metal in the plating bath. Examples of chelating agents include polyamines; aminocarboxylic acids; hydroxycarboxylic acids.

In some embodiments, the conventional acidic copper electroplating bath additive(s) can include at least one additive selected from the group consisting of reaction products of bisphenol A and ethylene oxide; polyether compounds; organic divalent sulfur compounds; organopropyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyalkylene glycols; block copolymers with the structure of $OH(EO)_x(PO)_y(EO)_zH$ where x, y, and z are integers between 1 and 10; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; arylamines, substituted phenylphenazinium compounds and substituted benzothiazole compounds.

In other embodiments, the aqueous acidic copper electroplating bath does not include or is free of a block copolymer having the formula: $R—O—(PO)_m—(EO)_n—H$, wherein EO is an oxyethylene group and PO is an oxypropylene group, R is an alkyl group or an alkenyl group having linear-chain or branched-chain structure and has a carbon number from 1 to 15, m is an integer from 1 to 30, and n is an integer from 1 to 40. Such block copolymers are described in, for example, U.S. Patent Application Publication No. 2013/0341199, which is herein incorporated by reference in its entirety.

The pH of the plating bath can be maintained to promote the efficient plating of copper on a substrate or work piece. In one embodiment, the pH is about 3 or less. In another embodiment, the pH is about 2 or less. In yet another embodiment, the pH is about 1 or less. The pH of the plating bath may be adjusted using an acid or a basic compound. For example, sodium hydroxide and/or sulfuric acid may be used to adjust the pH of the bath.

During electroplating a substrate, the temperature of the plating bath is maintained to promote the efficient plating of copper on a substrate or work piece. In one embodiment, the temperature of the copper plating bath, during plating, is about 15° C. to about 40° C., for example, about 19° C. to about 32° C.

The current density can be imposed from an energy source through the electrodes causing copper ions from the copper electroplating bath to migrate towards and attach to the substrate or work piece forming a layer of copper thereon. Due, in part, to the components present in the copper electroplating bath, a wide range of current densities may be employed. In one embodiment, current densities of about 0.1 to about 8 $A/dm^2$ (e.g., about 0.5 to 5 $A/dm^2$) can be used.

Any anode, cathode, power source, bath container, agitator, etc. suitable for plating metal, such as copper on a substrate or work piece may be employed. In some embodiments, a copper plate can be used as the anode. Advantageously, a strong air agitation can be maintained during electroplating to obtain a uniform satin deposit.

Any suitable source of power is connected to the electrodes, such as direct current or alternating current. Once the electrodes and the substrate or work piece are in contact or immersed in the copper electroplating bath, a current can be applied. Once a copper layer of desired thickness is deposited on the substrate, the plated substrate is removed from the electroplating bath and optionally rinsed with water. The plated substrate or work piece may then be subjected to further processing.

The length of time that the substrate or work piece is in contact with the plating bath under a specified current density depends upon the desired thickness of the resultant copper layer and the concentrations of the bath components. In one embodiment, the substrate or work piece is in contact with the plating bath under a specified current density for a time of about 5 seconds or longer and about 360 minutes or shorter. In another embodiment, the substrate or work piece is in contact with the plating bath under a specified current density for a time of about 10 seconds or longer and about 180 minutes or shorter. In yet another embodiment, the substrate or work piece is in contact with the plating bath under a specified current density for a time of about 30 seconds or longer and about 30 minutes or shorter.

In one embodiment, the thickness of the resultant copper layer electroplated as described herein can be about 0.1 micron or more and about 1,000 microns or less. In another embodiment, the thickness of the resultant copper layer electroplated as described herein can be about 1 micron or more and about 100 microns or less.

The present invention is further illustrated by the following examples. These examples are provided for illustration and are not to be construed as limiting the scope or content of the invention in any way.

Example 1

The copper electroplating bath described herein was used in a method of electrodepositing a satin layer of copper on the surface of a work piece. Experiments were conducted on brass items with a surface comprising from 0.1 $dm^2$ to 0.7 $dm^2$. The brass items were submitted to the preparation sequence as described below:

Alkaline cathodic cleaner (PRESOL 7073—4 V—50° C.—1 minute)

Acidic activation (PICKLANE 33—room temperature—30 seconds)

The items were then plated with an acidic copper electrolyte CUBRAC 660 from the company COVENTYA using the following parameters:

3 $A/dm^2$—room temperature

Time to reach sufficient copper thickness (10-15 μm)

The copper plated items were then plated with a satin copper layer using the following electrolyte:

130-180 g/L $CuSO_4.5H_2O$ 110-150 g/L $H_2SO_4$ 50-70 mg/L NaCl 20-200 mg/L non-ionic surfactant 2-50 mg/L sulfur compound 100-300 mg/L block copolymer R—O—(EO)m—(PO)n—H (satin additive)

The operating conditions to obtain the satin copper layer were:

Current density 2 $A/dm^2$

Temperature 27° C.

Time of deposition: 10 minutes to reach 5 μm

Air agitation

Figure 2:
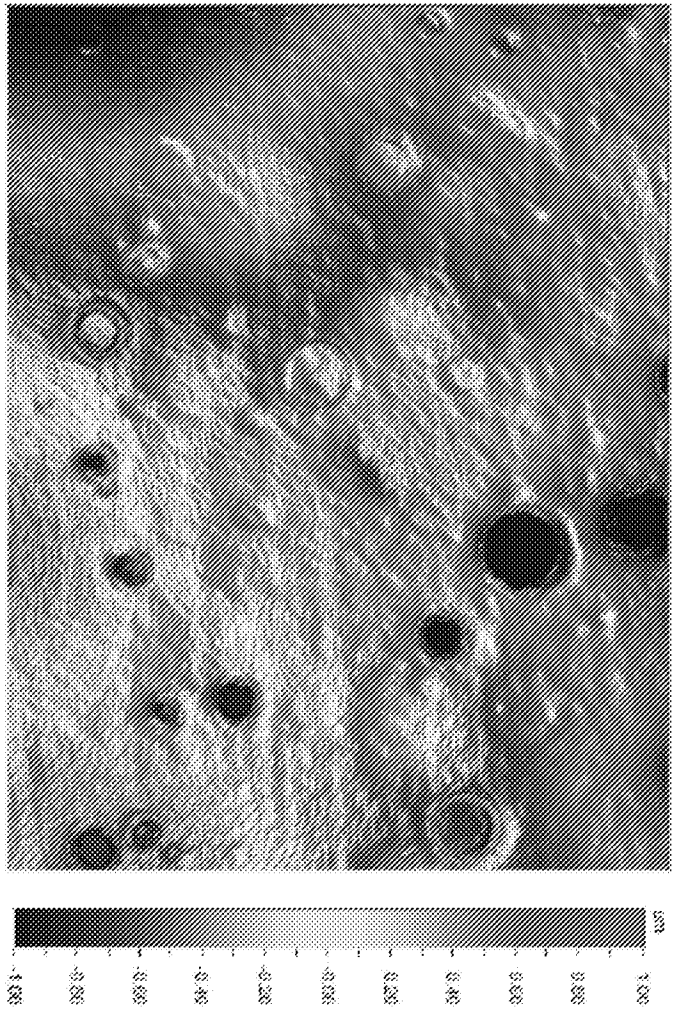
FIG. 2 illustrates an image showing a profile of a satin copper deposit (Ra=261 nm).

The satin copper layer obtained is characterized by a roughness of about 200 nm to about 1 μm, depending on the satin aspect desired. The roughness is measured with a Wyko NT 1100 profilometer with an objective of 50×—FOV: 1.0×. FIG. 1 and FIG. 2 illustrate profiles of a satin nickel deposit and satin copper deposit to compare the two aspects.

Figure 3:
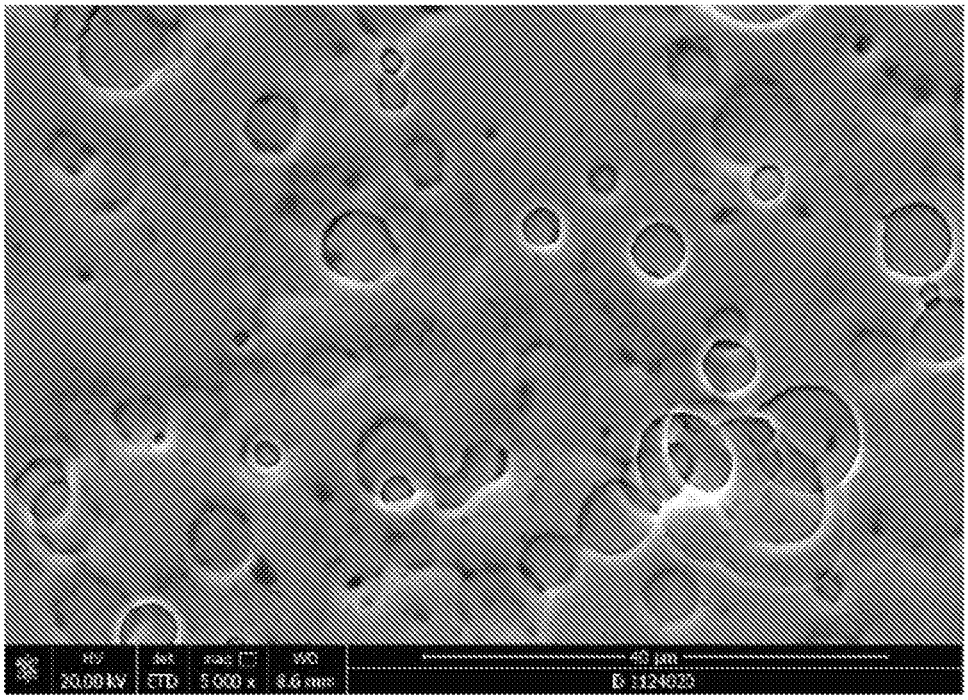
FIG. 3 illustrates an SEM image of a satin nickel deposit (20 kV—×5000).
Figure 4:
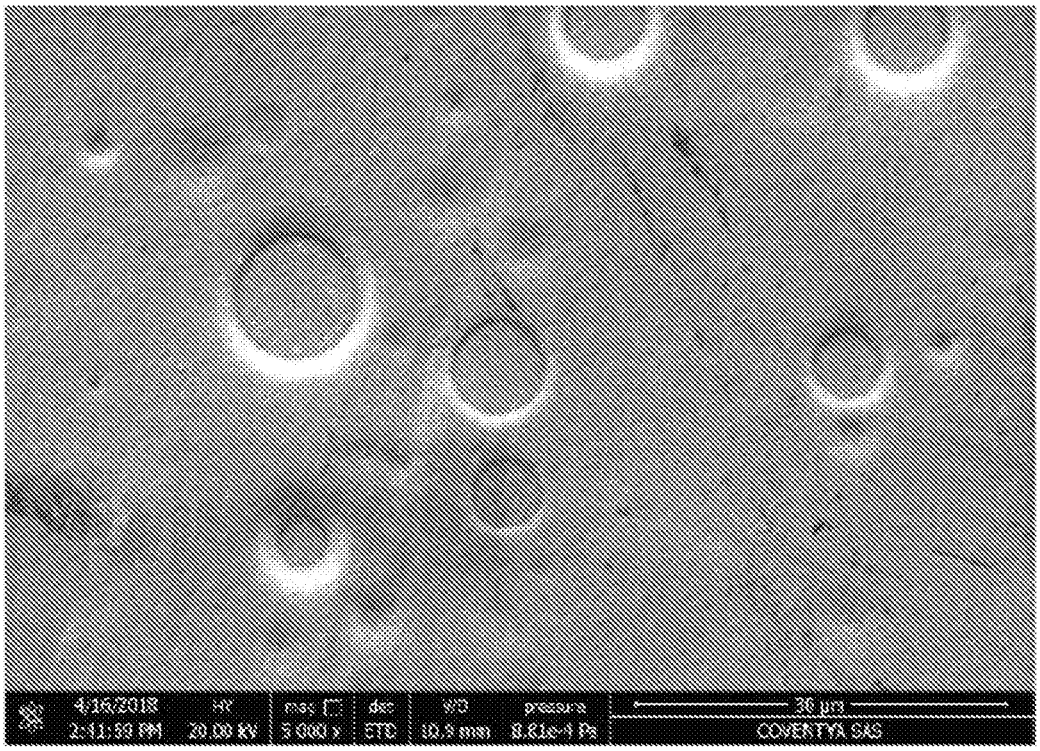
FIG. 4 illustrates an SEM image of a satin copper deposit (20 kV—×5000).

The satin copper layer obtained has a specific microstructure with drops, which are characteristics of the deposit, such as in satin nickel. FIG. 3 and FIG. 4 are SEM pictures of the two microstructures. The apparatus used to make the measurement is a FEI quanta 250 FEG with an ETDetector with high vacuum.

Example 2

Copper layers were electrodeposited on substrate under similar conditions as Example 1 using: (A) an acidic copper electroplating baths with CUBRAC 2900 brightener from the company COVENTYA and a conventional non-ionic surfactant at a similar concentration as CUBRAC 2900; and (B) an acidic copper electroplating baths with CUBRAC 2900 brightener, a conventional non-ionic surfactant at a similar concentration as CUBRAC 2900, and a block copolymer having a structure of R—O—$(EO)_m$—$(PO)_n$—H (satin additive)). The results are shown in FIGS. 5-18.

Figure 5A:
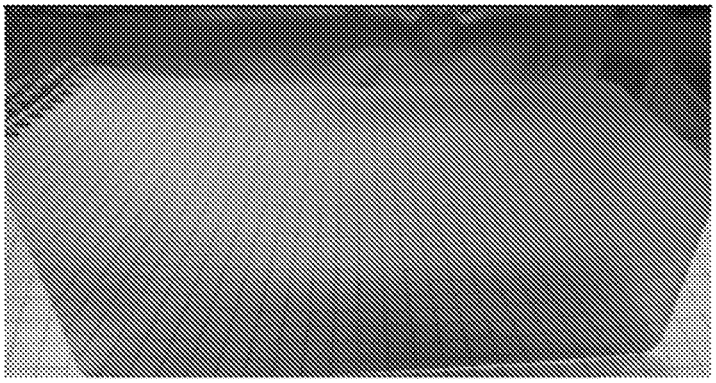
FIGS. 5(A-B) illustrate images of: (A) a bright copper deposit electroplated using a conventional copper plating bath with a CUBRAC 2900 brightener; and (B) a satin copper deposit electroplated using a conventional copper plating bath with a CUBRAC 2900 brightener and a block copolymer having a structure of R—O—$(EO)_m$—$(PO)_n$—H (satin additive).
Figure 5B:
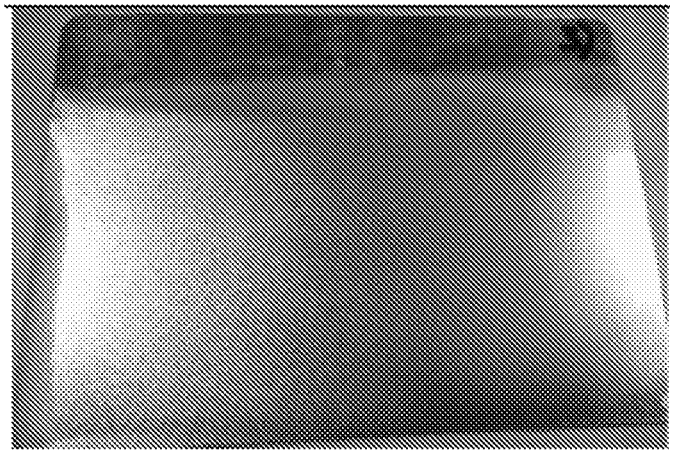

FIGS. 5(A-B) illustrate images of: (A) a bright copper deposit electroplated using a conventional copper plating bath with a CUBRAC 2900 brightener; and (B) a satin copper deposit electroplated using a conventional copper plating bath with a CUBRAC 2900 brightener and a block copolymer having a structure of R—O—$(EO)_m$—$(PO)_n$—H (satin additive).

Figure 6A:
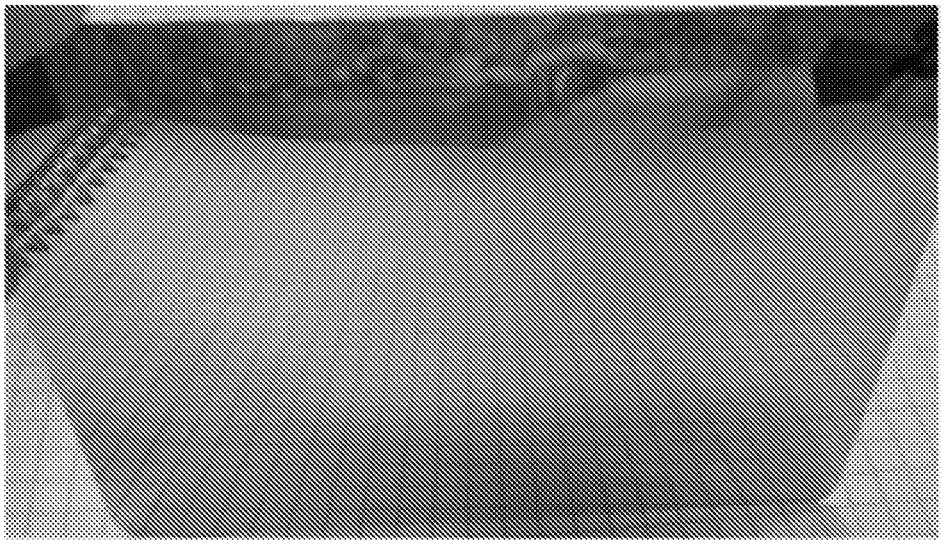
FIGS. 6(A-B) illustrate images of: (A) a bright copper deposit electroplated using a conventional copper plating bath with a CUBRAC 2900 brightener and POLYGLYKOL B11/30 surfactant; and (B) a satin copper deposit electroplated using a conventional copper plating bath with CUBRAC 2900 brightener, POLYGLYKOL B11/30 surfactant, and a block copolymer having a structure of R—O—$(EO)_m$—$(PO)_n$—H (satin additive).
Figure 6B:
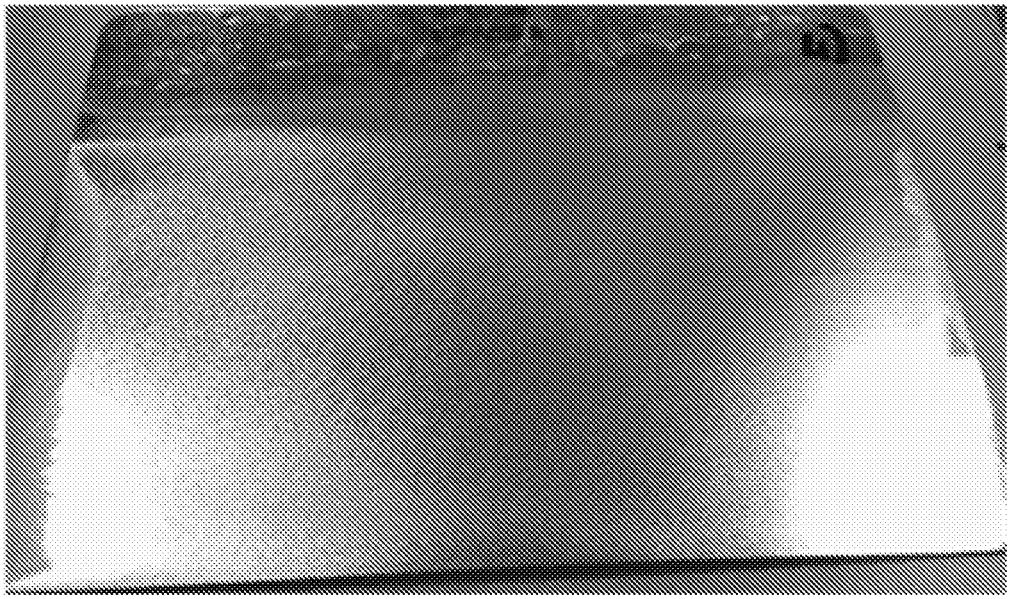

FIGS. 6(A-B) illustrate images of: (A) a bright copper deposit electroplated using a conventional copper plating bath with a CUBRAC 2900 brightener and POLYGLYKOL B11/30 surfactant; and (B) a satin copper deposit electroplated using a conventional copper plating bath with CUBRAC 2900 brightener, POLYGLYKOL B11/30 surfactant, and a block copolymer having a structure of R—O—$(EO)_m$—$(PO)_n$—H (satin additive).

Figure 7A:
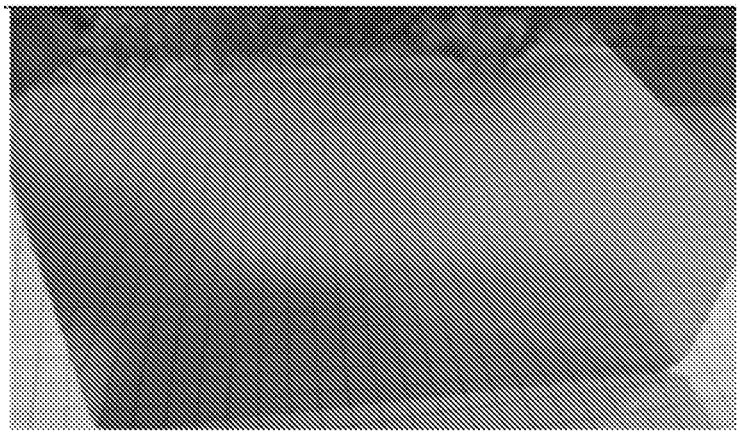
FIGS. 7(A-B) illustrate images of: (A) a bright copper deposit electroplated using a conventional copper plating bath with a CUBRAC 2900 brightener and POLYGLYKOL B11/100 surfactant; and (B) a satin copper deposit electroplated using a conventional copper plating bath with CUBRAC 2900 brightener, POLYGLYKOL B11/100 surfactant, and a block copolymer having a structure of R—O—$(EO)_m$—$(PO)_n$—H FIGS. 8(A-B) illustrate images of: (A) a bright copper deposit electroplated using a conventional copper plating bath with a CUBRAC 2900 brightener and POLYGLYKOL D21/150 surfactant; and (B) a satin copper deposit electroplated using a conventional copper plating bath with a CUBRAC 2900 brightener, POLYGLYKOL D21/150 surfactant, and a block copolymer having a structure of R—O—$(EO)_m$—$(PO)_n$—H (satin additive).
Figure 7B:
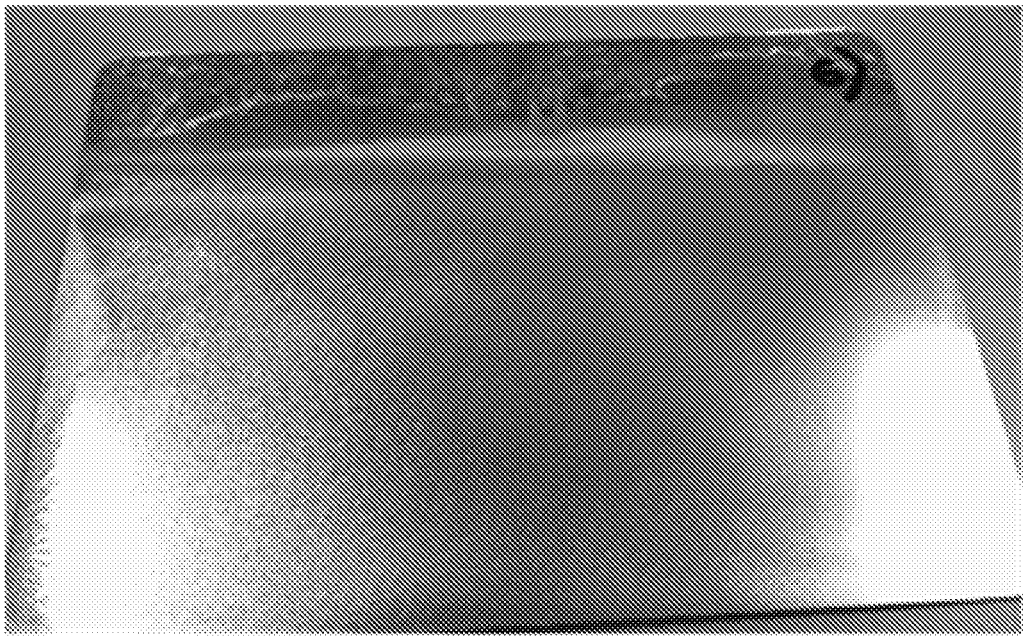

FIGS. 7(A-B) illustrate images of: (A) a bright copper deposit electroplated using a conventional copper plating bath with a CUBRAC 2900 brightener and POLYGLYKOL B11/100 surfactant; and (B) a satin copper deposit electroplated using a conventional copper plating bath with CUBRAC 2900 brightener, POLYGLYKOL B11/100 surfactant, and a block copolymer having a structure of R—O—$(EO)_m$—$(PO)_n$—H (satin additive).

Figure 8A:
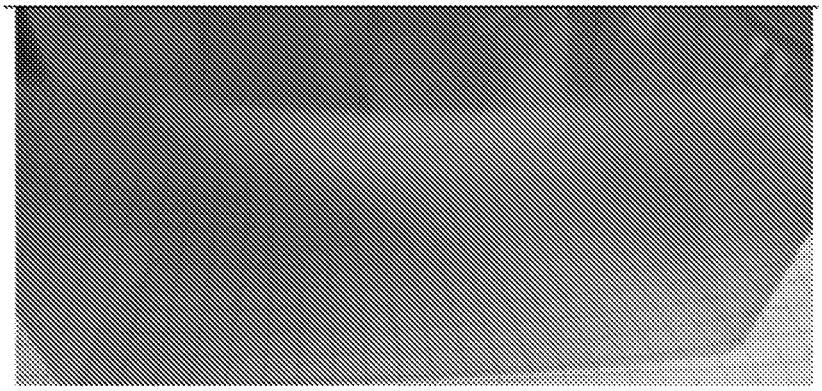
Figure 8B:
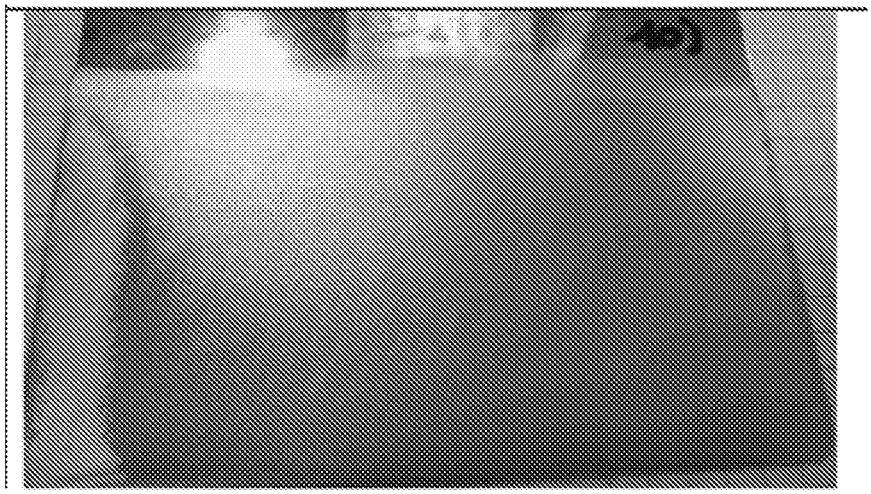

FIGS. 8(A-B) illustrate images of: (A) a bright copper deposit electroplated using a conventional copper plating bath with a CUBRAC 2900 brightener and POLYGLYKOL D21/150 surfactant; and (B) a satin copper deposit electroplated using a conventional copper plating bath with a CUBRAC 2900 brightener, POLYGLYKOL D21/150 surfactant, and a block copolymer having a structure of R—O—$(EO)_m$—$(PO)_n$—H (satin additive).

Figure 9A:
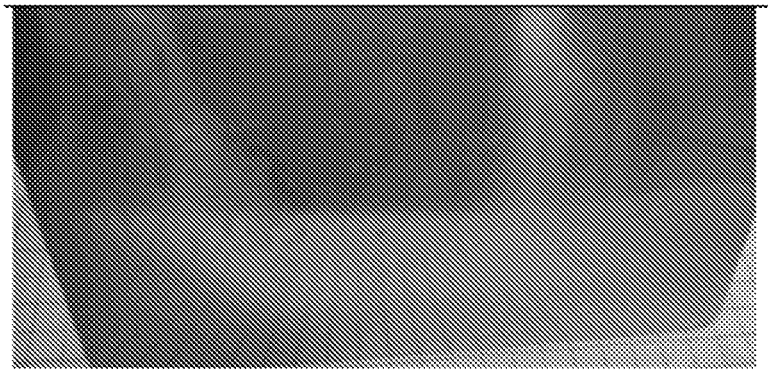
FIGS. 9(A-B) illustrate images of: (A) a bright copper deposit electroplated using a conventional copper plating bath with a CUBRAC 2900 brightener and PLURONIC PE 6200 surfactant; and (B) a satin copper deposit electroplated using a conventional copper plating bath with a CUBRAC 2900 brightener, PLURONIC PE 6200 surfactant, and a block copolymer having a structure of R—O—$(EO)_m$—$(PO)_n$—H (satin additive).
Figure 9B:
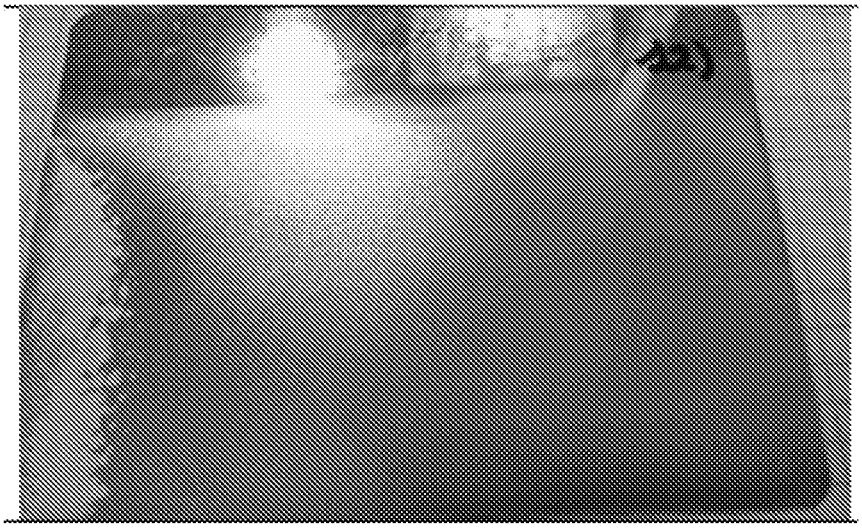

FIGS. 9(A-B) illustrate images of: (A) a bright copper deposit electroplated using a conventional copper plating bath with a CUBRAC 2900 brightener and PLURONIC PE 6200 surfactant; and (B) a satin copper deposit electroplated using a conventional copper plating bath with a CUBRAC 2900 brightener, PLURONIC PE 6200 surfactant, and a block copolymer having a structure of R—O—$(EO)_m$—$(PO)_n$—H (satin additive).

Figure 10A:
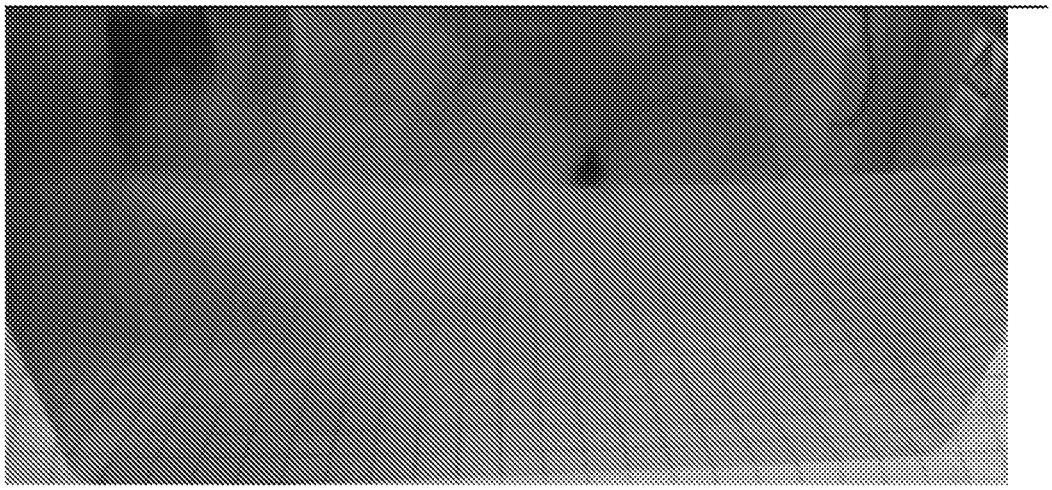
FIGS. 10(A-B) illustrate images of: (A) a bright copper deposit electroplated using a conventional copper plating bath with a CUBRAC 2900 brightener and PLURONIC PE 6800 surfactant; and (B) a satin copper deposit electroplated using a conventional copper plating bath with a CUBRAC 2900 brightener, PLURONIC PE 6800 surfactant, and a block copolymer having a structure of R—O—$(EO)_m$—$(PO)_n$—H (satin additive).
Figure 10B:
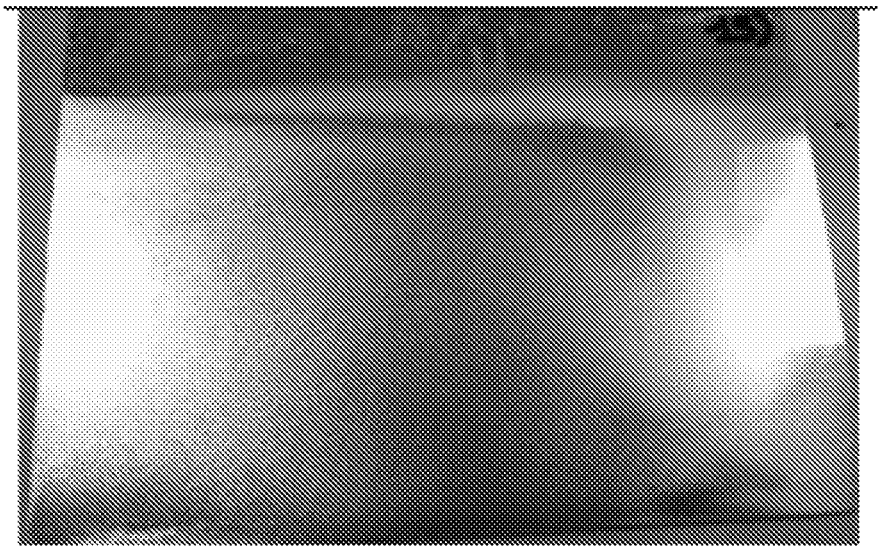

FIGS. 10(A-B) illustrate images of: (A) a bright copper deposit electroplated using a conventional copper plating bath with a CUBRAC 2900 brightener and PLURONIC PE 6800 surfactant; and (B) a satin copper deposit electroplated using a conventional copper plating bath with a CUBRAC 2900 brightener, PLURONIC PE 6800 surfactant, and a block copolymer having a structure of R—O—$(EO)_m$—$(PO)_n$—H (satin additive).

Figure 11A:
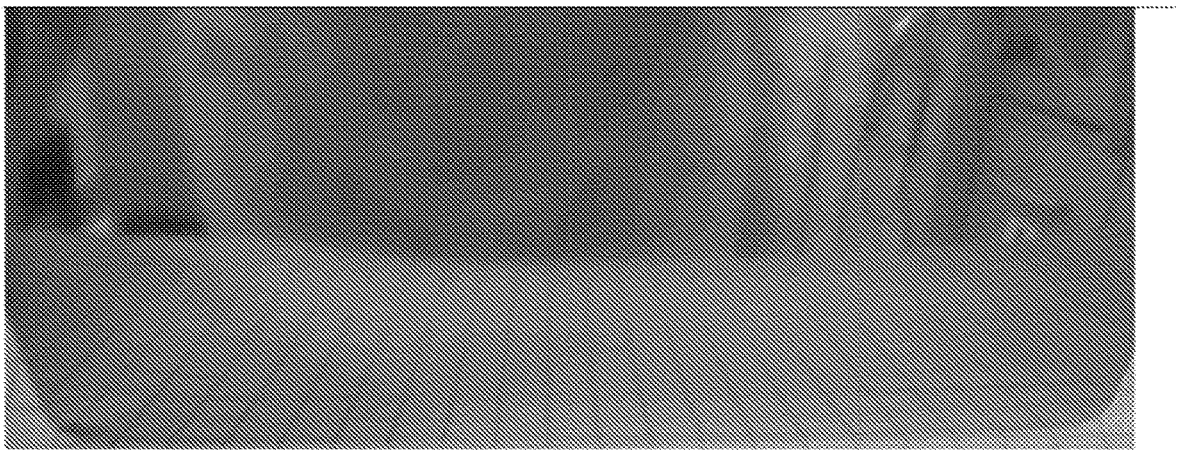
FIGS. 11(A-B) illustrate images of: (A) a bright copper deposit electroplated using a conventional copper plating bath with a CUBRAC 2900 brightener and PLURONIC RPE 1740 surfactant; and (B) a satin copper deposit electroplated using a conventional copper plating bath with a CUBRAC 2900 brightener, PLURONIC RPE 1740 surfactant, and a block copolymer having a structure of R—O—$(EO)_m$—$(PO)_n$—H (satin additive).
Figure 11B:
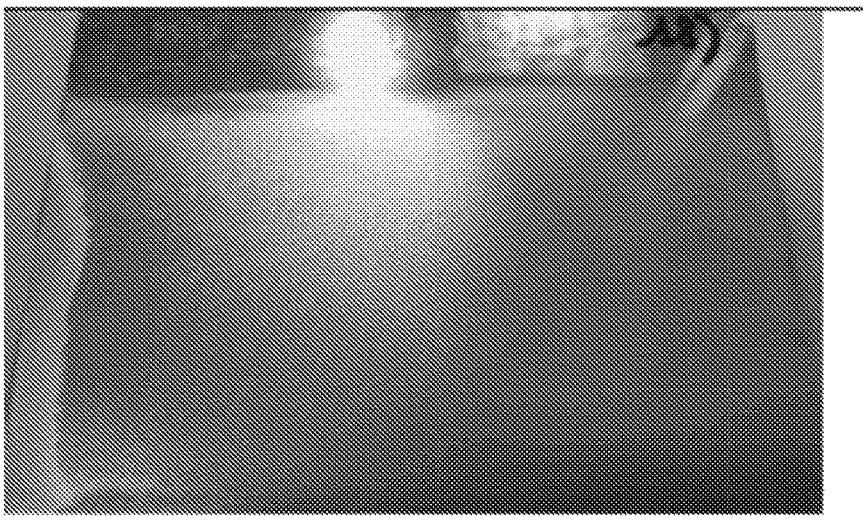

FIGS. 11(A-B) illustrate images of: (A) a bright copper deposit electroplated using a conventional copper plating bath with a CUBRAC 2900 brightener and PLURONIC RPE 1740 surfactant; and (B) a satin copper deposit electroplated using a conventional copper plating bath with a CUBRAC 2900 brightener, PLURONIC RPE 1740 surfactant, and a block copolymer having a structure of R—O—$(EO)_m$—$(PO)_n$—H (satin additive).

Figure 12A:
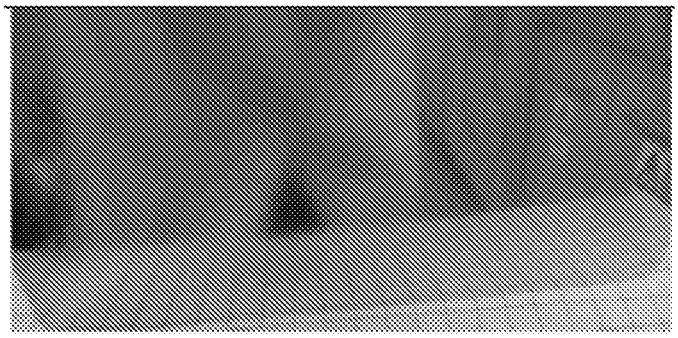
FIGS. 12(A-B) illustrate images of: (A) a bright copper deposit electroplated using a conventional copper plating bath with a CUBRAC 2900 brightener and DEHYPON GRA surfactant, and (B) a satin copper deposit electroplated using a conventional copper plating bath with a CUBRAC 2900 brightener, DEHYPON GRA surfactant, and a block copolymer having a structure of R—O—$(EO)_m$—$(PO)_n$—H (satin additive).
Figure 12B:
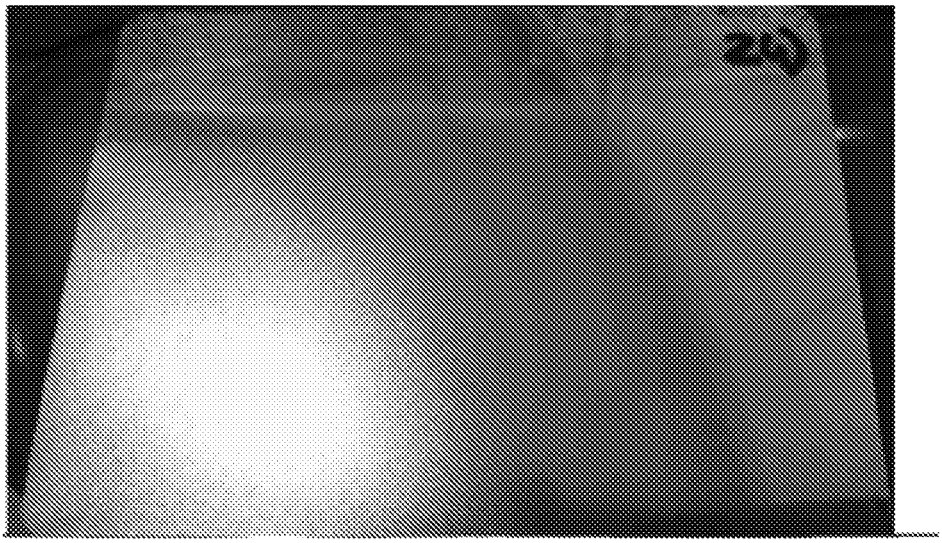

FIGS. 12(A-B) illustrate images of: (A) a bright copper deposit electroplated using a conventional copper plating bath with a CUBRAC 2900 brightener and DEHYPON GRA surfactant, and (B) a satin copper deposit electroplated using a conventional copper plating bath with a CUBRAC 2900 brightener, DEHYPON GRA surfactant, and a block copolymer having a structure of R—O—$(EO)_m$—$(PO)_n$—H (satin additive).

Figure 13A:
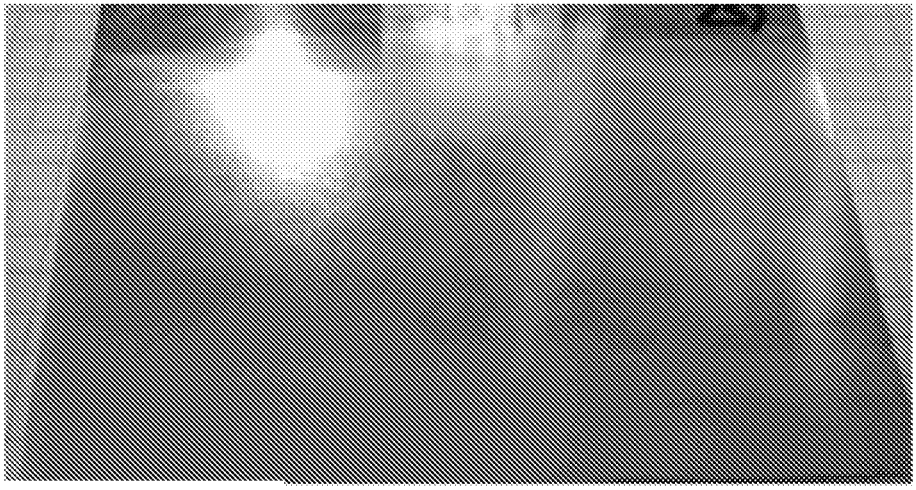
FIGS. 13(A-B) illustrate images of: (A) a bright copper deposit electroplated using a conventional copper plating bath with a CUBRAC 2900 brightener and DEHYPON WET surfactant; and (B) a satin copper deposit electroplated using a conventional copper plating bath with a CUBRAC 2900 brightener, DEHYPON WET surfactant, and a block copolymer having a structure of R—O—$(EO)_m$—$(PO)_n$—H (satin additive).
Figure 13B:
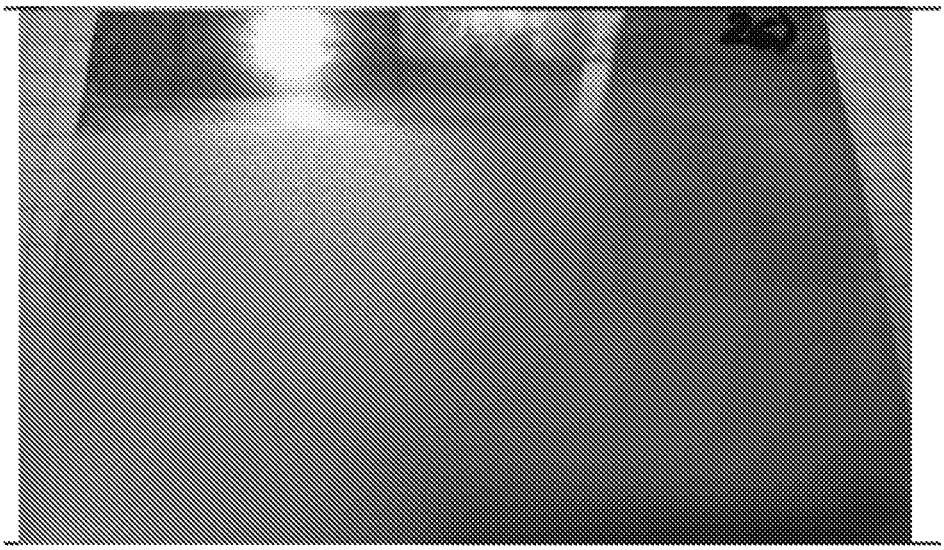

FIGS. 13(A-B) illustrate images of: (A) a bright copper deposit electroplated using a conventional copper plating bath with a CUBRAC 2900 brightener and DEHYPON WET surfactant; and (B) a satin copper deposit electroplated using a conventional copper plating bath with a CUBRAC 2900 brightener, DEHYPON WET surfactant, and a block copolymer having a structure of R—O—$(EO)_m$—$(PO)_n$—H (satin additive).

Figure 14A:
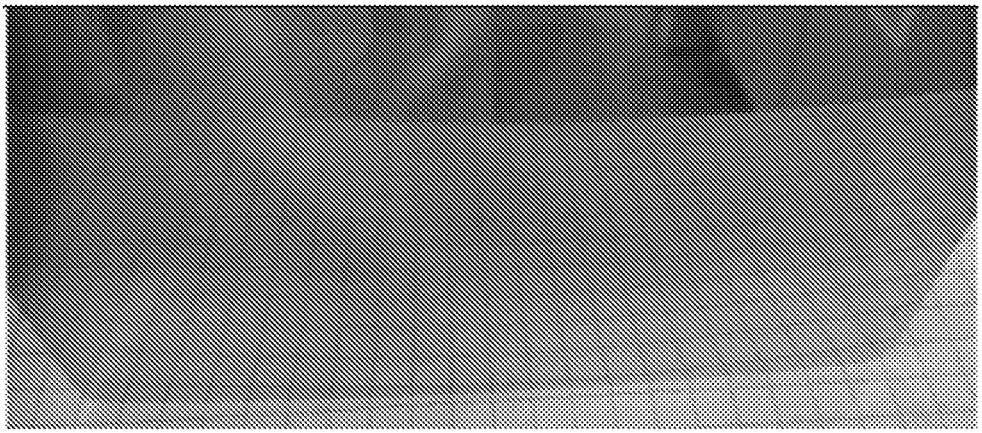
FIGS. 14(A-B) illustrate images of: (A) a bright copper deposit electroplated using a conventional copper plating bath with a CUBRAC 2900 brightener and PEG 4000 surfactant; and (B) a satin copper deposit electroplated using a conventional copper plating bath with a CUBRAC 2900 brightener, PEG 4000 surfactant, and a block copolymer having a structure of R—O—$(EO)_m$—$(PO)_n$—H (satin additive).
Figure 14B:
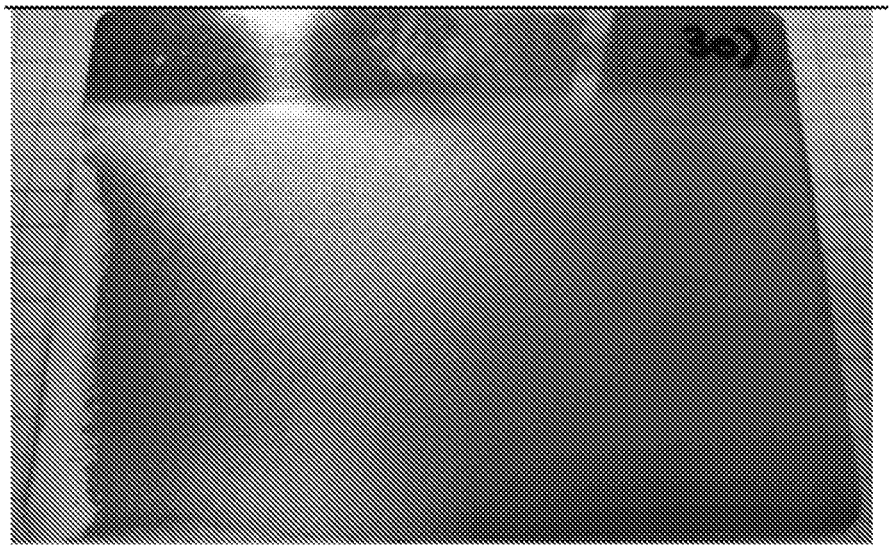

FIGS. 14(A-B) illustrate images of: (A) a bright copper deposit electroplated using a conventional copper plating bath with a CUBRAC 2900 brightener and PEG 4000 surfactant; and (B) a satin copper deposit electroplated using a conventional copper plating bath with a CUBRAC 2900 brightener, PEG 4000 surfactant, and a block copolymer having a structure of R—O—$(EO)_m$—$(PO)_n$—H (satin additive).

Figure 15A:
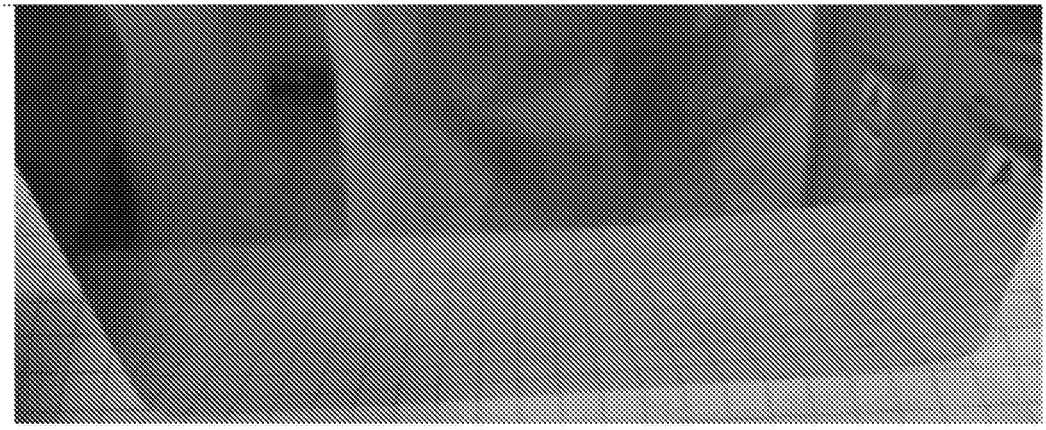
FIGS. 15(A-B) illustrate images of: (A) a bright copper deposit electroplated using a conventional copper plating bath with a CUBRAC 2900 brightener and PEG 12000 surfactant; and (B) a satin copper deposit electroplated using a conventional copper plating bath with a CUBRAC 2900 brightener, PEG 12000 surfactant, and a block copolymer having a structure of R—O—$(EO)_m$—$(PO)_n$—H (satin additive).
Figure 15B:
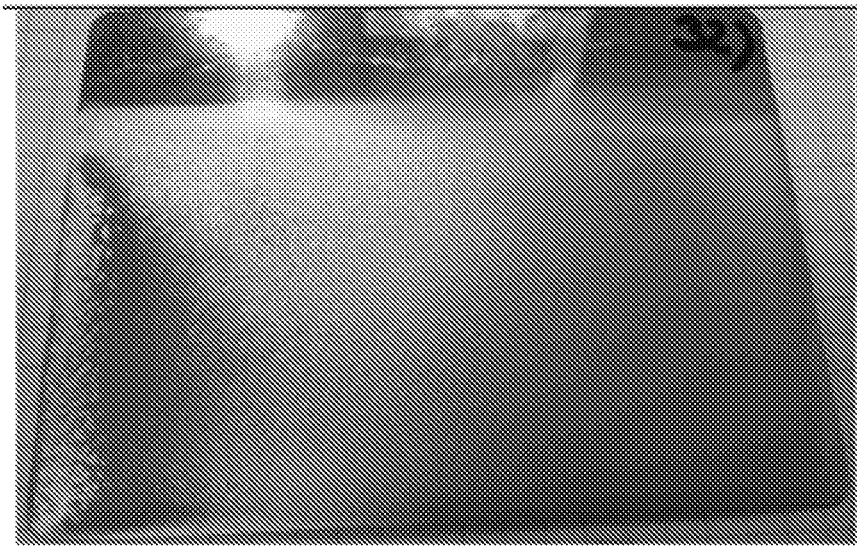

FIGS. 15(A-B) illustrate images of: (A) a bright copper deposit electroplated using a conventional copper plating bath with a CUBRAC 2900 brightener and PEG 12000 surfactant; and (B) a satin copper deposit electroplated using a conventional copper plating bath with a CUBRAC 2900 brightener, PEG 12000 surfactant, and a block copolymer having a structure of R—O—$(EO)_m$—$(PO)_n$—H (satin additive).

As shown in the foregoing Figures, the inclusion of the satin additive described herein in the acidic copper electroplating bath provided the electrodeposited copper layers with a substantially uniform satin appearance.

From the above description of the invention, those skilled in the art will perceive improvements, changes and modifications. Such improvements, changes and modifications within the skill of the art are intended to be covered by the appended claims. All patents and publications cited herein are incorporated by reference in their entirety.

The invention claimed is:

1. An aqueous acidic copper electroplating bath that produces a satin deposit, the. bath comprising:

a source of copper ions, an acid, a satin additive, and optionally one or more acidic copper electroplating bath additive(s), wherein the satin additive includes a block copolymer with the structure of $RO(EO)_m(PO)_nH$ where EO is an oxyethylene group, PO is an oxypropylene group, R represents an alkyl group or alkenyl group having, a linea or branched chain structure and having a carbon number of 5 to 20, in is an integer of 3 to 6, and n is an integer of 3 to 6, wherein m is equal to or less than n;

wherein the aqueous copper electroplating bath deposits a satin layer of copper on a surface of a substrate upon electroplating the substrate in the bath.

2. The aqueous acidic copper electroplating bath of claim 1, wherein the block copolymer has the general formula (I):

$$RO—(CH_2—CH_2—O)_m—(\underset{\underset{CH_3}{|}}{CH}—CH_2—O)_n—H. \quad (I)$$

3. The aqueous acidic copper electroplating bath of claim 1, wherein the acidic copper electroplating bath additive(s) comprises at least one additive selected from the group consisting of reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyaikylene glycols; block copolymers with the structure of OH(EO)x(PO)y(EO)zH where x, y, and z are integers between 1 and 10; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; arylamines, substituted phenylphenazinium compounds and substituted benzothiozole compounds.

4. The aqueous acidic copper electroplating bath of claim 1, wherein the satin additive is provided in the aqueous acidic copper electroplating bath at a concentration of about 1 mg/L to about 1 g/L.

5. The aqueous acidic copper electroplating bath of claim 1, wherein the source of copper ions comprises a copper salt and the copper salt is provided in the aqueous acidic copper electroplating bath at a concentration of about 50 g/L to about 260 g/L.

6. The aqueous acidic copper electroplating bath of claim 1, wherein the acid is selected from sulfuric acid, fluoboric acid, phosphoric acid, alkane sulfonic acid, an alkanol sulfonic acid and combinations thereof.

7. The aqueous acidic copper electroplating bath of claim 1, wherein the acid is provided in the aqueous acidic copper electroplating bath at a concentration of about 50 g/L to about 260 g/L.

8. The aqueous acidic copper electroplating bath of claim 1, wherein the aqueous acidic copper electroplating bath further comprises halide ions.

9. The aqueous acidic copper electroplating bath of claim 8, wherein the halide ions are provided in the aqueous acidic copper electroplating bath at a concentration of about 20 mg/I to about 200 mg/I.

10. The aqueous acidic copper electroplating bath of claim 1, wherein the aqueous acidic copper electroplating bath is free of a block copolymer having the formula R—O—$(PO)_m$—$(EO)_n$—H, wherein EO is an oxyethylene group and PO is an oxypropylene group, R is an alkyl group or an alkenyl group having linear-chain or branched-chain structure and has a carbon number from 1 to 15, m is an integer from 1 to 30, and n is an integer from 1 to 40.

11. The aqueous acidic copper electroplating bath of claim 1, wherein the aqueous acidic copper electroplating bath further comprises a leveling agent selected from the group consisting of condensation products of thiourea and aliphatic aldehydes, thiazolidinethiones, imidazolidinethiones and quaternized polyamines.

12. A method for deposition of copper onto a substrate comprising, In this order, the steps:

a. providing a substrate, b. contacting the substrate with the aqueous acidic copper electroplating bath of claim 1, and c. applying an electrical current between the substrate and at leaast one anode, and thereby depositing copper onto the substrate, wherein the copper deposited onto the substrate is a satin copper layer.

13. The method of claim 12, wherein the pH of the aqueous acidic copper electroplating bath is maintained at 3 or less during the deposition of the copper onto the substrate.

14. The method of claim 12, wherein the temperature of the aqueous acidic copper electroplating bath is maintained at about 19° C. to about 32°C. during the deposition of the copper onto the substrate.

15. The method of claim 12, wherein the current density during the deposition of the copper onto the substrate is about 0.1 to about 8 $A/dm^2$.

16. The method of claim 12, wherein the satin copper layer has a roughness of between about 200 nm and 1 μm.

* * * * *